United States Patent [19]

Gerard

[11] 4,293,091

[45] Oct. 6, 1981

[54] REINFORCED CONTAINER WITH INTEGRAL DIVIDER

[75] Inventor: Thomas J. Gerard, Winter Haven, Fla.

[73] Assignee: Weyerhaeuser Company, Tacoma, Wash.

[21] Appl. No.: 108,976

[22] Filed: Jan. 2, 1980

[51] Int. Cl.[3] ..... B65D 5/48; B65D 5/50

[52] U.S. Cl. ..... 229/27; 229/DIG. 4; 229/15

[58] Field of Search ..... 229/27, 28, 15, DIG. 4

[56] References Cited

U.S. PATENT DOCUMENTS

| | | | |
|---|---|---|---|
| 1,703,213 | 2/1929 | Shugart et al. | 229/27 |
| 1,737,950 | 12/1929 | Scotland | 229/27 |
| 1,898,231 | 2/1933 | Weiss | 229/27 |
| 2,643,811 | 6/1953 | Bolding | 229/27 |
| 2,850,224 | 9/1958 | Meinhardt et al. | 229/27 |
| 2,983,421 | 5/1961 | Turpin | 229/27 X |
| 3,009,625 | 11/1961 | Ackley et al. | 229/41 R |
| 3,049,279 | 8/1962 | Mairs et al. | 229/27 |
| 3,115,290 | 12/1963 | Byassee | 229/27 X |
| 3,199,762 | 8/1965 | Coons | 229/27 |
| 3,199,763 | 8/1965 | Anderson | 229/DIG. 4 |
| 3,201,022 | 8/1965 | Glassco et al. | 229/15 |
| 3,326,444 | 6/1967 | Farquhar et al. | 229/27 |
| 3,954,220 | 5/1976 | Foster | 229/27 |

*Primary Examiner*—Davis T. Moorhead

*Attorney, Agent, or Firm*—Weyerhaeuser Company

[57] ABSTRACT

A container which has integral reinforcing panels and a divider panel and is formed from a unitary blank.

3 Claims, 6 Drawing Figures

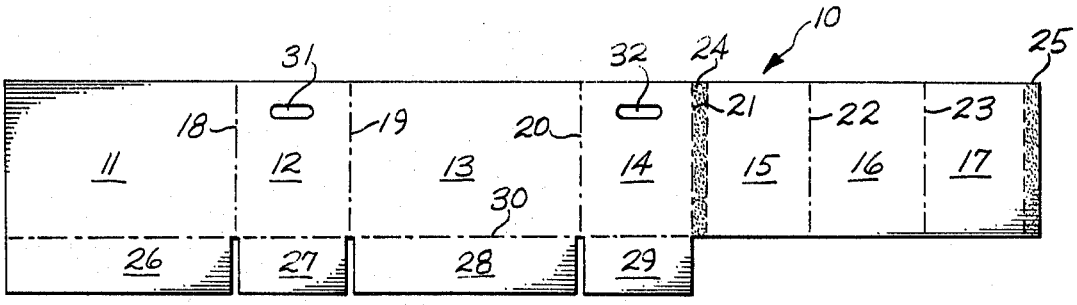
Fig. 1
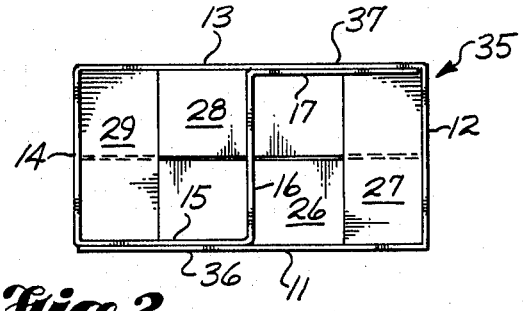
Fig. 2
Fig. 3
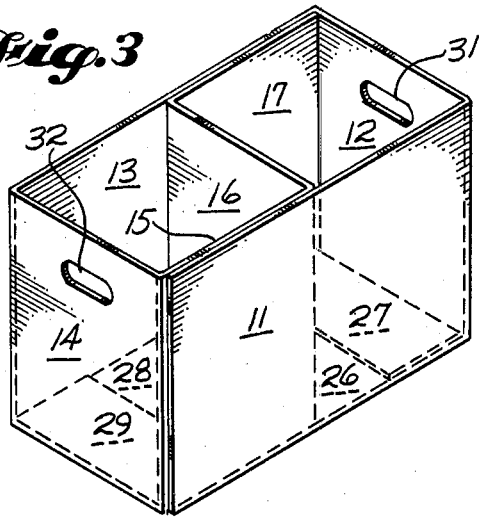
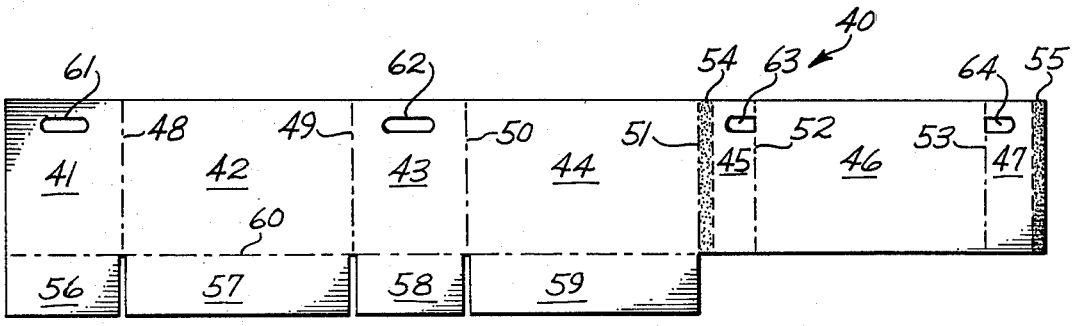
Fig. 4
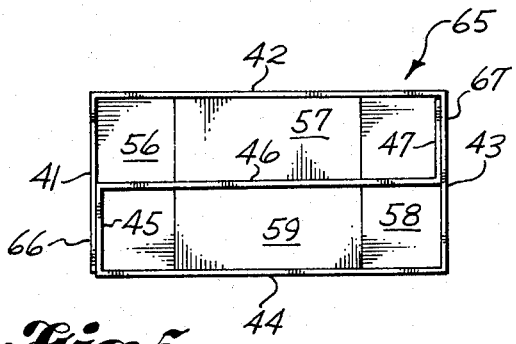
Fig. 5
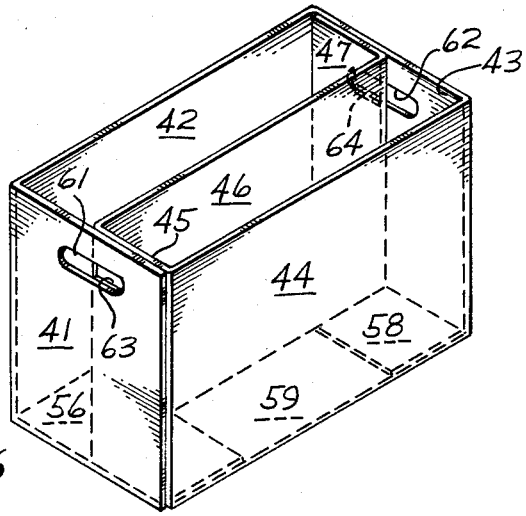
Fig. 6

REINFORCED CONTAINER WITH INTEGRAL DIVIDER

BACKGROUND OF THE INVENTION

1. Field of the Invention

A reinforced container with integral divider.

2. Prior Art

Scotland, U.S. Pat. No. 1,737,950 discloses a food package having an integral divider panel 10. The outer panel 11 attached to the divider panel 10 is split into upper and lower sections which are turned in opposite directions and therefore do not extend from the top to the bottom of the container. Only the edge 5 of the outer wall is securely cemented to the part 6 near the edge 7. The part 6 is attached to divider panel 10.

Bolding, U.S. Pat. No. 2,643,811 also discloses a container with integral divider. The divider does not extend the height of the container, but only the height of the aperture in one wall of the container. The divider is attached by small attachment flap 42. A joinder section 32 is flexibly connected to the free margin of the outer wall.

Glassco, et al, U.S. Pat. No. 3,201,022 discloses a container having a series of dividers which are adhered to the side walls of the containers. The adhesive does not extend from the top to the bottom of the walls nor are the dividers integral with the rest of the container.

Ackley, et al, U.S. Pat. No. 3,009,625 discloses a container having a separate divider which is stapled to the side walls.

Coons, U.S. Pat. No. 3,199,762 discloses a collapsible container having an integral divider. The divider is held by a small flap 39 on one side and is attached to the outer wall 16.

SUMMARY OF THE INVENTION

The present container was developed to provide both stacking strength and an integral divider while using less board than normal. The divider panel extends between two opposing side walls. The reinforcing panels are attached to the divider panel and extend in opposite directions from the divider panel. Each extends along a side wall from the divider panel to the edge of the wall. Each of the reinforcing panels also extends from the top to the bottom of the container and is completely adhered to the side wall to provide the additional stacking strength. In the blank the four side walls, the reinforcing panels and the divider panel are unitary.

BRIEF DESCRIPTION OF THE DRAWINGS

FIG. 1 is a top plan view of a blank for the container.

FIG. 2 is a top plan view of the container.

FIG. 3 is an isometric view of the container.

FIG. 4 is a top plan view of a blank for a modified container.

FIG. 5 is a top plan view of the container formed from the blank of FIG. 4.

FIG. 6 is an isometric view of the container.

DESCRIPTION OF THE PREFERRED EMBODIMENTS

In FIG. 1 the blank 10 is divided into a side wall 11, an end wall 12, a side wall 13, an end wall 14, a reinforcing panel 15, a divider panel 16 and a reinforcing panel 17 by score lines 18–23. The blank is partially crushed at 24 along score line 21 and along the outer edge 25 of panel 17. Bottom panels 26, 27, 28 and 29 are attached to the panels 11–14 respectively along score line 30. Hand holes 31 and 32 are formed in end panels 12 and 14.

Reinforcing panels 15 and 17 are the same height as the side walls. The entire face of each reinforcing panel is adhered to its side wall, panel 15 being adhered to side wall 11 to form reinforcing section 36 and panel 17 being adhered to side wall 13 to form reinforcing section 37. Divider panel 16 extends between the reinforcing panels, and the reinforcing sections are on opposite sides of the divider panel in the container 35.

A reinforcing panel may also reinforce the end panels rather than the side panels and the divider panel may extend the length of the container instead of the width of the container. This change is shown in FIGS. 4–6.

In FIG. 4 the blank 40 is divided into an end wall 41, a side wall 42, an end wall 43, a side wall 44, a reinforcing panel 45, a divider panel 46 and a reinforcing panel 47 by score lines 48–53. Again the blank is crushed at 54 along score line 51 and along the outer edge 55 of reinforcing panel 47. Closure panels 56, 57, 58 and 59 are attached to the walls 41–44 along score line 60. In the container 65 the reinforcing panel 45 is adhered to end wall 41 to form a reinforcing section 66 and the reinforcing panel 47 is adhered to end panel 43 to form the reinforcing section 67. Hand holes 61 and 62 are formed in end walls 41 and 43 and partial hand holes 63 and 64 are formed in reinforcing panels 45 and 47. These align with the hand holes 61 and 62 in the container 65. Again, reinforcing sections 66 and 67 are in opposite sides of divider panel 46.

What is claimed is:

1. A container having an integral divider panel and reinforcing panels comprising first, second, third and fourth upstanding side walls, said first and third side walls being of equal width and said second and fourth side walls being of equal width, a divider panel extending between said first and third side walls, a first reinforcing panel extending along said first side wall from the junction of said first and fourth side walls to said divider panel, said reinforcing panel being the same height as said first side wall and being completely adhered to said first side wall, said reinforcing panel being attached to said divider panel;

a second reinforcing panel extending along said third side wall from said divider panel to the juncture of the third side wall with the second side wall, said second reinforcing panel being the same height as said third side wall and being completely adhered to said third side wall, said second reinforcing panel being attached to said divider panel.

2. The container of claim 1 in which said first reinforcing panel is attached to said fourth wall.

3. The container of claims 1 or 2 in which hand holes are formed in said first and third side walls, and corresponding partial hand holes are formed in said reinforcing panels.

* * * * *